US005580293A

United States Patent [19]

Sestak et al.

[11] Patent Number: 5,580,293

[45] Date of Patent: Dec. 3, 1996

[54] TOY STAIRWAY

[76] Inventors: Joseph T. Sestak, 4016 Allison Ave.; Anthony H. Lariccia, 4675 Village St., both of Erie, Pa. 16506

[21] Appl. No.: 434,773

[22] Filed: May 4, 1995

[51] Int. Cl.[6] ..... A63H 15/00

[52] U.S. Cl. ..... 446/75; 446/107; 446/109; 446/479; 446/486; 446/489

[58] Field of Search ..... 446/107–110, 476, 446/478, 479, 482, 486, 487, 488; 40/539, 610; 52/188, 191; 108/100; 312/259; 434/72, 79; 211/135, 186, 149, 130, 195

[56] References Cited

U.S. PATENT DOCUMENTS

| | | | |
|---|---|---|---|
| 1,609,945 | 12/1926 | Hermani | 211/135 |
| 1,747,981 | 2/1930 | Marsh | 108/100 |
| 1,886,532 | 11/1932 | Davidson | 211/135 |
| 1,931,521 | 10/1933 | Zeimmerman | 108/100 |
| 1,964,880 | 7/1934 | Katz | 108/100 |
| 1,987,439 | 1/1935 | Froehlig | 211/135 |
| 2,062,165 | 11/1936 | Davidson | 211/135 |
| 2,153,422 | 4/1939 | Kroman | 211/135 |
| 2,307,992 | 1/1943 | Calhoun et al. | 211/195 |
| 2,326,493 | 8/1943 | Pringle et al. . | |
| 2,506,237 | 5/1950 | Roach | 211/135 |
| 2,595,002 | 4/1952 | Schneider . | |
| 2,728,461 | 12/1955 | Paige . | |
| 2,751,706 | 6/1956 | Metal . | |
| 2,789,701 | 4/1957 | Rath . | |
| 3,726,412 | 4/1973 | Resnicoff . | |
| 3,863,575 | 2/1975 | Kuns et al. | 211/135 |
| 4,506,790 | 3/1985 | Muscari | 211/135 |
| 4,582,003 | 4/1986 | Valero | 108/111 |

FOREIGN PATENT DOCUMENTS

| | | | |
|---|---|---|---|
| 1365419 | 5/1964 | France | 211/186 |
| 358183 | 9/1922 | Germany | 446/478 |

*Primary Examiner*—Robert A. Hafer
*Assistant Examiner*—Jeffrey D. Carlson
*Attorney, Agent, or Firm*—Lovercheck and Lovercheck

[57] ABSTRACT

A toy stairway is disclosed which may be used to play with a spring toy and which comprises elongated first and second collapsible side rails in confronting spaced relationship relative to each other, a plurality of rigid steps disposed between the first and second side rails, and means for releasably connecting the plurality of steps to the first and second side rails. Each side rail may be coilable and resilient, or may be foldable and comprised of a plurality of hingedly connected fold sections. The first and second side rails preferably are formed from a single stringer having a first portion and a second portion, the stringer being made of a material to permit the stringer to bend for bringing the second portion in a confronting spaced relationship relative to the first portion to define the first and second side rails. The stringer may be made of a coilable resilient material or of a foldable material comprised of a plurality of hingedly connected fold sections. Each of the rigid steps preferably comprises an L-shaped step piece having a tread portion and a riser portion, or each of the rigid steps may comprise a flat tread and the toy staircase may further comprise at least one brace portion connectable between the side rails. Each of the rigid steps may comprise a tread portion hingedly attached to a riser portion, and there may be a plurality of the hingedly attached tread and riser portions hingedly attached to each other to form a continuous set of the rigid steps.

18 Claims, 4 Drawing Sheets

TOY STAIRWAY

BACKGROUND OF THE INVENTION

1. Field of the Invention

The present invention relates to toy stairways and, more particularly, is directed to toy stairways for use with a spring toy that can be disassembled and packaged into a compact package.

2. Description of the Invention Background

Perhaps one of the most ubiquitous child's toys has been a spring toy consisting of a elongated steel band wound in a circular fashion to form a coil. This toy achieved its popularity largely under the brand name Slinky™ shown and described in U.S. Pat. No. 4,114,306 issued on Sep. 19, 1978. The Slinky's popularity has been associated with all generations. The play value of this toy resides in its many unique features—when holding the toy with one end in one hand and the other end in another hand the coils will unravel in the direction of the lower hand when one hand is raised or lowered. The movement conveys the feeling of a living creature moving in ones hand. Additionally, the spring toy creates an interesting visual pattern and radiates a sound while it moves, further capturing the interest of and mesmerizing the user.

One of the spring toy's most significant play values, however, is its unique ability to "walk" down a stairway or incline when a user mechanically starts the motion of the toy by advancing one of the top coils of the toy to the next lower level. The momentum of these top coils carries through to the remaining coils, causing them to follow the top coils in turn to the next lower level, and in the process appearing to "walk" down to the next lower level. At this lower level, the momentum of the coils which are now on top causes them to flip over and fall to the next further lower level, thus repeating the motion. This "walking" movement continues until the toy reaches the bottom of the stairway or incline.

However, a large percentage of the nation's households lack a stairway of sufficient length to effectuate the "walking" movement, thus eliminating one of the spring toy's more significant play values. For instance, many people live in apartments located within apartment buildings. Such apartments typically do not have stairs inside the apartment, and although there may be exit stairs in the building, these stairs may be inappropriate for play because these stairs are outside of the apartment, are typically unattractive and unpleasant play areas, and a child playing on such stairs would likely require adult supervision. Another large percentage of the population lives in houses which also do not have stairs, for instance one-story houses with no basement, common in coastal and rural areas and present everywhere.

Even in households where there are stairs present, such stairs may not be ideal for playing with the spring toy. Parents may not want children playing around stairways without adult supervision, for fear that toys would be left on the stairway, or that the children could potentially fall down the stairs. Furthermore, a standard stairway may not be the most effective means of effectuating the "walking" action. The standard ratio of the rise of the stairs to the run of the stairs in a typical stairway may not promote good "walking" action. Also, carpeted stairs, common in many homes, impair the "walking" action of the spring toy.

In such situations where there are either no stairs available, or the stairs available are ineffective, the user can construct a simulated stairway with a stack of books or similar objects. This requires a large number of books to create enough steps for good "walking" action. Finding enough books or similar objects is usually a problem and thus limits the play value of the toy. An inclined plane can also be used to effectuate the "walking" action. A wooden board (for instance, about 36 inches long and 6 to 8 inches wide) can be elevated at one end and used as an incline to "walk" the toy down. However, common boards do not work well because the spring toy will slide on it. Therefore, a board with a non-slip surface is preferred. While such boards may be fabricated or may be available at a building supply center, they are not commonly found around the home.

Thus, there is a need for a practical, convenient and safer way of utilizing the play value of the "walking" feature of the spring toy. There is a need for a toy stairway designed to facilitate the "walking" motion of the spring toy.

However, such a toy stairway will occupy significantly more space than the spring toy itself. This reduces the ability to ship, store and market such a toy stairway in a retail store. In today's competitive retail sales market, there is a premium on shelf space, storage space and shipping capacity at every level of the distribution chain. Products which are bulky and sell for a relatively low sales price cannot compete with smaller, higher-profit products. This applies to the toy stairway, where the product logically should not have a retail cost significantly greater than the spring toy itself, yet the final usable configuration may occupy ten times the space of the spring toy. Therefore, there is a need for a toy stairway which can be packaged in a small carton along with the spring toy for shipping, storing, marketing and merchandising purposes. The size of a toy stairway also may be a problem in small homes where storage space is not prevalent. Thus, there is a further need for a toy stairway which can be disassembled and packaged in a small carton along with the spring toy for storage after play.

It is important, however, that a toy stairway designed for use with a spring toy which can be packaged in a small, compact package for merchandising and storage purposes be easy and quick to put together. Few qualities of a toy discourage play by a youngster more than difficulty of assembly. Thus, there is a still further need for a toy stairway that can be easily assembled.

Accordingly, the present invention provides a toy stairway that will facilitate the "walking" motion of the spring toy, that can be packaged in a small carton along with the spring toy for shipping, merchandising and storage benefits, and that can be easily assembled. In addition to those features, other details, objects, and advantages will become apparent as the following detailed description of the present preferred embodiment thereof proceeds.

SUMMARY OF THE INVENTION

In accordance with the present invention, there is provided a toy stairway comprising elongated first and second collapsible side rails in confronting spaced relationship relative to each other, a plurality of rigid steps disposed between the first and second side rails, and means for releasably connecting the plurality of steps to the first and second side rails. Each side rail may be coilable and resilient, or may be foldable and comprised of a plurality of hingedly connected fold sections. The first and second side rails preferably are formed from a single stringer having a first portion and a second portion, the stringer being made of a material to permit the stringer to bend for bringing the second portion in a confronting spaced relationship relative to the first portion to define the first and second side rails.

The stringer may be made of a coilable resilient material or of a foldable material comprised of a plurality of hingedly connected fold sections.

Each of the rigid steps preferably comprises an L-shaped step piece having a tread portion and a riser portion, or each of the rigid steps may comprise a flat tread and the toy staircase may further comprise at least one brace portion connectable between the side rails. Each of the rigid steps may comprise a tread portion hingedly attached to a riser portion, and there may be a plurality of the hingedly attached tread and riser portions hingedly attached to each other to form a continuous set of the rigid steps. The means for connecting the steps between the side rails comprises first connecting means attached to the steps, and second connecting means attached to each of the first and second side rails for interlockingly engaging the first connecting means.

BRIEF DESCRIPTION OF THE DRAWINGS

In the accompanying drawings, a present preferred embodiment of the invention is shown wherein like reference numerals are employed to designate like parts and wherein.

DETAILED DESCRIPTION OF THE PREFERRED EMBODIMENTS

Figure 1:
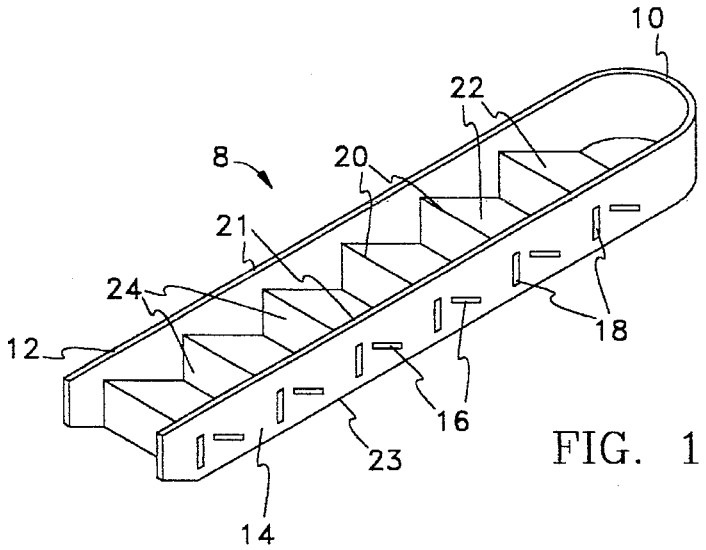
FIG. 1 is a front elevational view of an embodiment of the toy stairway of the present invention in assembled position.
Figure 2:
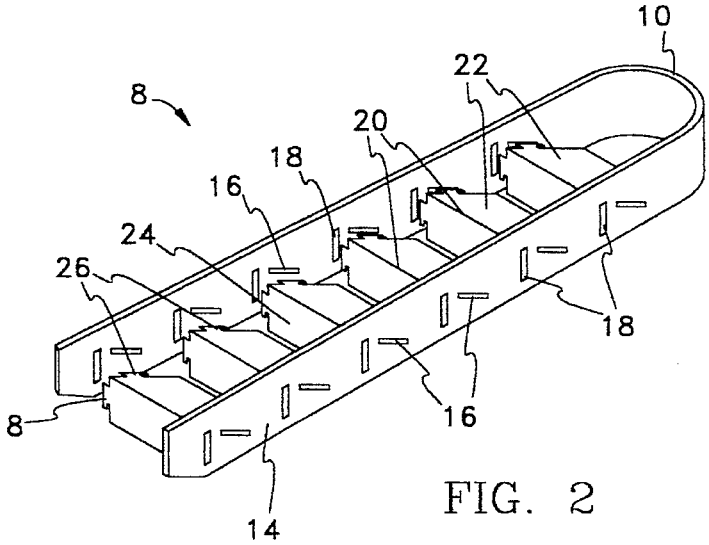
FIG. 2 is a front elevation view of the toy stairway of FIG. 1 in exploded configuration, showing the construction of this embodiment.

Referring now to the drawings for the purposes of illustrating the present preferred embodiment of the invention only and not for purposes of limiting the same, FIGS. 1–6 show an embodiment of the toy staircase apparatus generally designated as 8.

Figure 3:
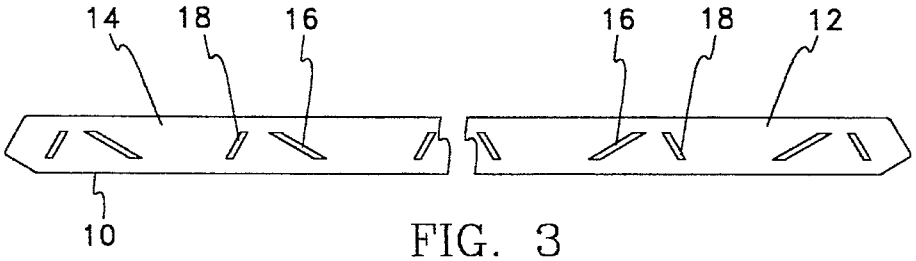
FIG. 3 is a plan view of the flexible stringer of the embodiment of the invention in FIG. 1.
Figure 4:
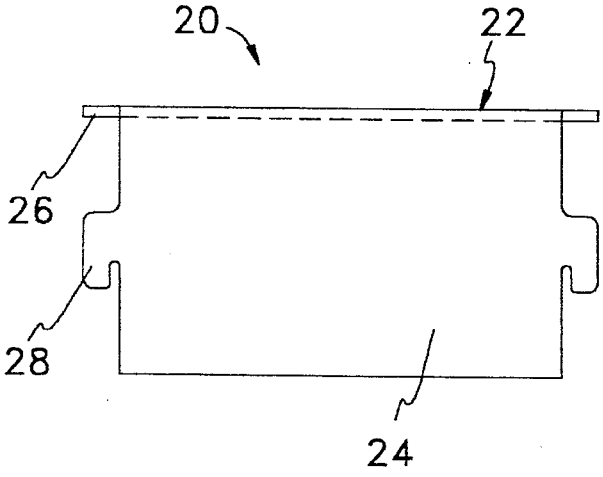
FIG. 4 is a front plan view of a step portion of the embodiment of the present invention shown in FIG. 1.
Figure 5:
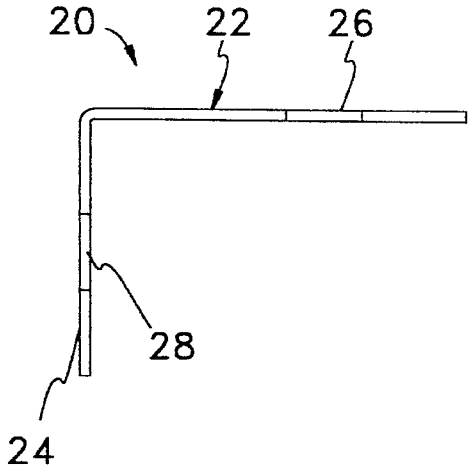
FIG. 5 is a side plan view of the step portion of the embodiment shown in FIG. 4.

The toy stairway 8 includes a single elongated resilient stringer 10 having generally straight generally parallel side edges 21 and 23 which is bent to form elongated first and second strip sections or elongated side rails 12 and 14 which are positioned in confronting spaced relationship with one another and define a spaced area between them. The resilient stringer 10 is formed of a flexible yet strong material that can be coiled into a compact cylinder to facilitate packaging, shipping, merchandising and storing. The material of the stringer 10 must be resilient in that it is capable of being coiled into a tight coil but will resume its uncoiled form when released. The stringer 10 is preferably plastic, but the stringer 10 may also be formed of heavy cardboard, flexible sheet metal, or other such material. When uncoiled and assembled, the flexible stringer 10 forms two side rails 12 and 14 of the stairway 8. As shown in FIG. 3, when uncoiled and unassembled, the flexible stringer 10 is a continuous elongated strip member, and side rails 12 and 14 become first and second portions or first and second elongated strip sections of the stringer 10. The stringer 10 is preferably approximately 3 inches wide, 84 inches long and 0.040 inches thick, and coils into a cylinder approximately 5 inches in diameter and 3 inches tall, but is not limited to these particular dimensions. The length of the stringer 10 depends on the desired length and number of steps on the toy stairway 8. Eighty four inches is the preferred length for approximately six steps.

The toy stairway 8 has a plurality of rigid substantially L-shaped step pieces 20, each of which comprises a tread portion 22 formed integral at a substantially right angle with a riser portion 24, disposed between the side rails 12 and 14. The step pieces 20 are formed of strong material, such as plastic, heavy cardboard, flexible sheet metal, or other such material. The step pieces 20 are proportioned to fit in the spaced area between the side rails 12 and 14 to form a continuous stairway 8. The treads 22 are approximately 5 inches wide, 5 inches deep, and 0.060 inches thick. The risers 24 are approximately 5 inches wide, 3 inches high, and 0.060 inches thick. The treads 22 and risers 24 can be constructed of different size and shape to provide a staircase for use with different size spring toys, to add a different number of steps in a given space, and/or to provide a different walking motion, as discussed below. Although it is preferred that the risers 24 be as wide as the treads 22 and reach from one tread 22 to the next, it is not necessary that the risers 24 be so shaped and sized.

When placed in the operable position, the side rails 12 and 14 of the flexible stringer 10 have numerous pairs of horizontal slots 16 and vertical slots 18 formed therein at right angles to one another. The treads 22 are formed with integral tabs 26 (FIG. 2) which interlockingly engage the horizontal slots 16 formed in the side rails 12 and 14 of the flexible stringer 10 so that the treads 22 are connected to the side rails 12 and 14. The risers 24 of the step pieces 20 are formed with integral tabs 28 (FIG. 2) which interlockingly engage the vertical slots 18 formed in the side rails 12 and 14 of the flexible stringer 10 so that the risers 24 are connected to the side rails 12 and 14. Various combinations of the integral tabs 26 and 28 of the treads 22 and the risers 24, respectively, and the horizontal slots 16 and vertical slots 18, respectively, of the side rails 12 and 14 may be eliminated, although this may produce some loss of rigidity of the toy stairway 8. The step pieces 20 are thus releasably connected to the side rails 12 and 14 of the flexible stringer 10 in this manner. Other methods of connecting these materials to one another are well known in the art, and can be used to connect the step pieces 20 to the side rails 12 and 14 of the stringer 10. Step pieces 20 may be permanently attached to the side rails 12 and 14 after assembly through the connection of the interlocking tabs 26 and 28 with the slots 16 and 18, respectively, or using well known attachment methods such as glue or other interlocking parts. However, such attachment limits disassembly and storage capability.

The toy stairway 8 is assembled by first uncoiling the stringer 10. The stringer 10 is then bent in the middle of its lengthwise direction to form both side rails 12 and 14 in a confronting spaced relationship. The tabs 26 and 28 on one side of one step piece 20 are fit into a horizontal slot 16 and a vertical slot 18, respectively, in either side rail 12 or 14. The tabs 26 and 28 on the opposite side of the step piece 20 are then fit into the corresponding horizontal slot 16 and vertical slot 18, respectively, of the other side rail 12 or 14. The remaining step pieces 20 are then similarly attached between the side rails 12 and 14 of the stringer.

To use the toy stairway 8, the curved end of the stringer 10 can be leaned against typical household objects of suitable size such as a chair or a coffee table. The toy stairway 8 is then in position to facilitate the "walking" motion of the spring toy. The spring toy may be "walked" down the toy stairway 8 by setting it on the top step, grasping the top of the spring toy, pulling it over and placing it on the next lower step. The lower portion of the spring toy will follow the upper portion over to the lower step, thus becoming the top portion. The momentum of traveling to the lower step, however, will carry the new upper portion over and down to the next step. This will continue for each step, with the spring toy traveling end over end down each step until it reaches the level surface such as the floor on which the toy stairway 8 is placed.

Spring toys are made in a variety of sizes. One typical spring toy size is approximately 3½ inches in diameter and 3½ tall. In effectuating the "walking" motion of a spring toy down a stairway, the tread and the riser must be of a certain size and the riser must be of a proper ratio to the tread for the spring toy to walk properly. The tread must be of a certain minimum width and depth so that the spring toy has sufficient horizontal surface on which to land. The minimum width and depth are approximately the width and depth of the spring toy itself. Similarly, if the tread is too large, the spring toy will not naturally fall to the next lower tread, but will instead fall over onto the same tread and come to a rest. This maximum size depends also on the height of the riser, but generally is about three times the width of the spring toy.

If the tread is too large compared to the riser, then the spring toy will not gain enough momentum to properly walk down the stairs, and will come to rest on the tread. If the tread is too small compared to the riser, then the spring toy will gain too much momentum, and the spring toy will overshoot the tread, disrupting the walking motion. The tread to riser ratio may be reduced or increased within the operable range to increase or decrease the speed of the walking motion. For a standard size spring toy, we prefer that the tread be approximately 5 inches deep and approximately 5 inches wide, and that the riser be approximately 3 inches high and approximately 5 inches wide, although other sizes and ratios of the tread and riser may work equally as well. For smaller spring toys, the tread 22 and the riser 24 may be made smaller, and for larger spring toys, the tread 22 and the riser 24 may be made larger.

An additional advantage of the present embodiment is that the entire toy stairway 8 may be turned over (not shown) and used with a different size spring toy. When turned over, the treads 22 become risers and the risers 24 become treads. The new treads would then be approximately 3 inches deep and the new risers would be approximately 5 inches high. The smaller treads of this configuration would accommodate a smaller spring toy.

Figure 6:
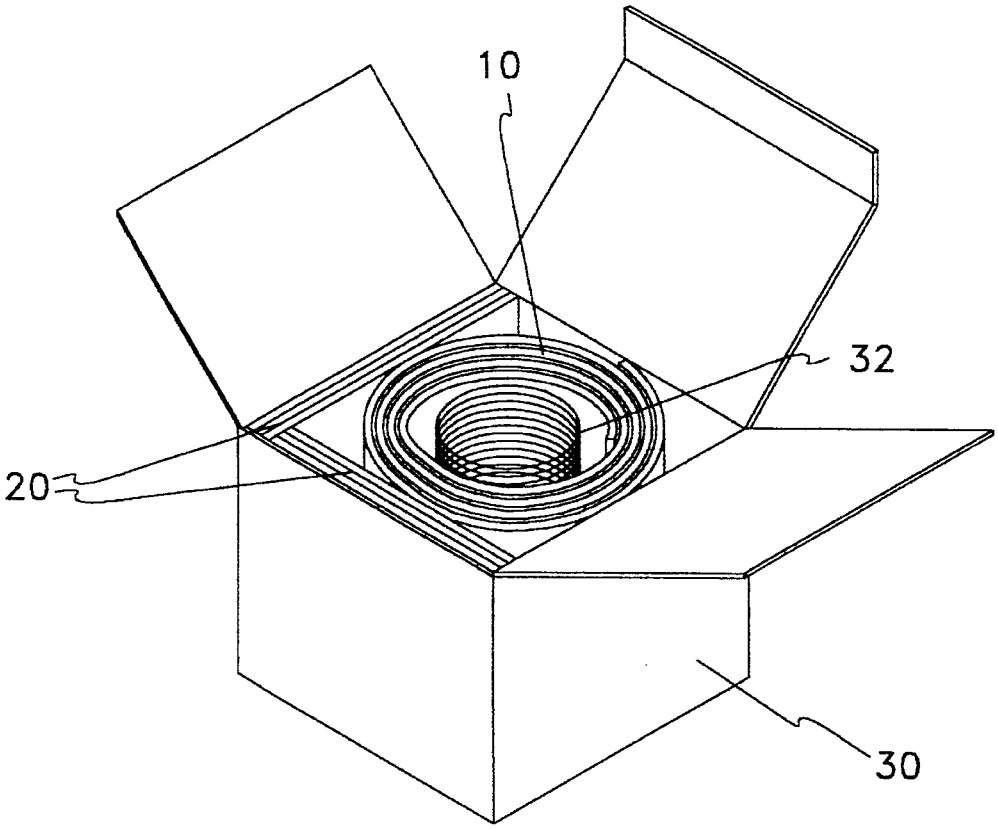
FIG. 6 is a front elevational view of the toy stairway in collapsed configuration, packaged within a box.

As shown in FIG. 6, the toy stairway 8 may be compactly packaged in a box 30 for shipping, merchandising or simply for storing. The toy stairway 8 is disassembled by reversing the order of assembly, as described above. The step pieces 20 are nested together and placed in the box 30 with the treads 22 facing down toward the bottom of the box 30 and the risers 24 facing one or more sides of the box 30, although the package is most compact if all the risers 24 all face the same side of the box 30. The flexible stringer 10 may then be coiled up and placed inside the box 30 on top of the step pieces 20. The spring toy 32 then can be inserted inside the coiled up stringer 10 inside the box 30. The length and width of the box will be slightly more than the dimensions of the tread 22 of the step pieces 20, and the depth of the box 30 will be the width of the flexible stringer 10 plus the thickness of all the step pieces 20. A typical box 30 for the preferred embodiment may be approximately 5½ inches by 5½ inches by 3½ inches tall, and constructed of known packaging material, such as cardboard.

Figure 7:
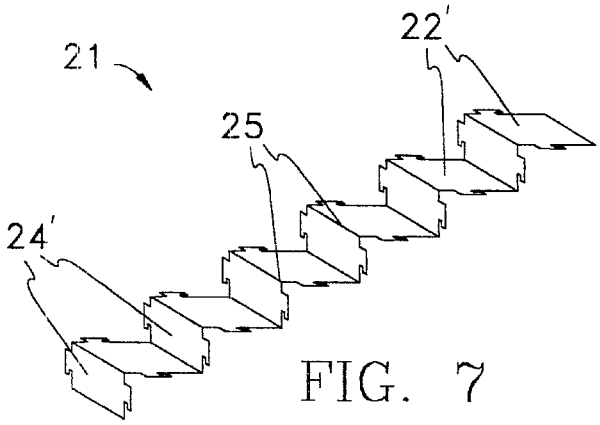
FIG. 7 is a front elevational view of a portion of an alternative embodiment of the present invention.

An alternate embodiment of the present invention is partially shown in FIG. 7, which shows the steps of the stairway formed of a one piece foldable step member 21. The foldable step member 21 has a plurality of hingedly attached tread portions 22' and riser portions 24' which are formed of a rigid strong material, such as plastic or the like, and which are integrally connected by hinges 25. Each of the tread portions 22' and riser portions 24' are also integrally attached to form a continuous set of rigid steps. Hinges 25 are typically formed of the same material as tread portions 22' and riser portions 24', but are thinner and are flexible. This type of hinge mechanism is known as a "living hinge". Foldable step member 21 can be folded multiple times along hinges 25 into a stack for packaging, merchandising and storing purposes. If the tread portions 22' and riser portions 24' are of different dimensions, each set of tread portions 22' and riser portions 24' may be flattened into the same plane and the sets of tread portions 22' and riser portions 24' can be folded over and stacked on one another, and the thus unassembled toy stairway may be packaged in a box of corresponding rectangular cross-section (not shown) instead of a box of cross-section corresponding to the size of the tread portions 22'. Of course, other folding patterns and other-shaped boxes may be used. Alternatively, multiple step members 21 of shorter length and fewer steps than the entire stairway may also be used. This step configuration may be combined with any of the stringer configurations disclosed herein.

Figure 8:
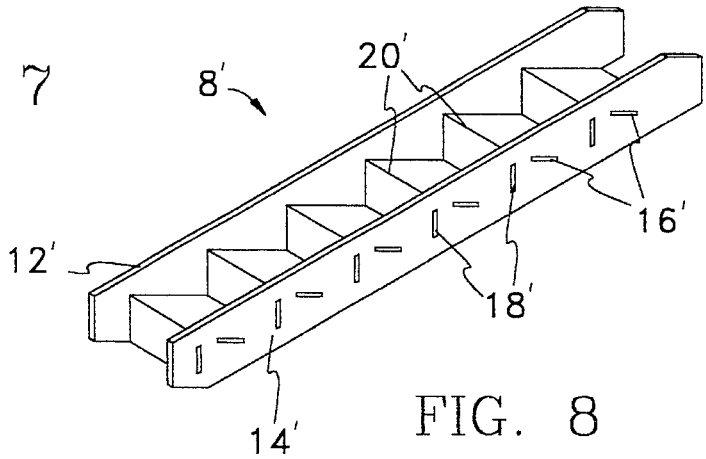
FIG. 8 is a front elevational view of another alternative embodiment of the present invention.

Another alternate embodiment of the present invention is shown in FIG. 8. In this embodiment, a toy stairway 8' is formed using two separate flexible stringers 12' and 14', instead of a single flexible stringer 10 as shown in FIGS. 1–6. Like the flexible stringer 10 shown in FIGS. 1–6, the flexible stringers 12' and 14' are formed of a flexible yet strong material, such as plastic, heavy cardboard, or flexible sheet metal, that can be coiled into cylinders which can be nested for packaging and merchandising purposes, but which will resume their uncoiled form when released. When uncoiled and assembled, the flexible stringers 12' and 14' form the side rails of the toy stairway 8'. The step pieces 20' may be the same as the step pieces 20 as shown in FIGS. 1–6 or step member 21 as shown in FIG. 7, and contain horizontal and vertical tabs (not shown) which interlock into horizontal slots 16' and vertical slots 18', respectively. This side rails configuration may be combined with any of the step configurations disclosed herein.

Figure 9:
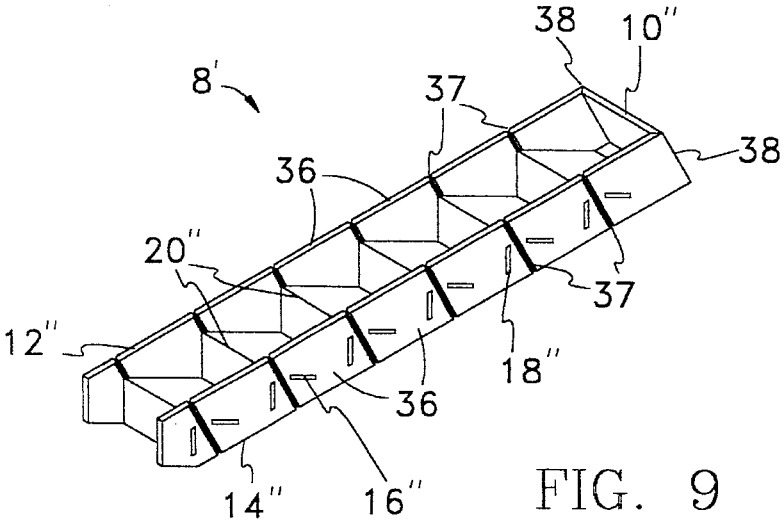
FIG. 9 is a front elevational view of another alternative embodiment of the present invention.

Another alternate embodiment of the present invention is disclosed in FIG. 9. In this embodiment, a toy stairway 8" is formed using a one piece stringer 10" that is foldable. The foldable stringer 10" has hingedly connected fold sections 36 which are formed of a rigid strong material, such as plastic or the like, and which are integrally connected by the hinges 37. The plurality of hinges 37 are formed integrally with fold sections 36 of plastic or like material that is typically thinner than fold sections 36 and flexible, or a "living hinge". Foldable stringer 10" can be folded multiple times into a stack of the fold sections 36 for packaging and merchandising purposes. To use the foldable stringer 10", the fold sections 36 are unfolded, and then are folded at right angle hinges 38 to form side rails 12" and 14". The step pieces 20" are the same as the step pieces 20 as shown in FIGS. 1–6 or step member 21 as shown in FIG. 7, and contain horizontal and vertical tabs (not shown) which interlock into the horizontal slots 16" and vertical slots 18", respectively. The hinges 37 of foldable stringer 10" are preferably located between each corresponding horizontal slot 16" and vertical slot 18" so that when in assembled position, the fold sections 36 are firmly held straight by the step pieces 20" butted across the hinges 37 and the horizontal and vertical tabs (not shown) of the step pieces 20 interlocked into the horizontal slots 16" and vertical slots 18", respectively. The foldable side rails 12" and 14" may also be made of two separate foldable side rails similar to the embodiment shown in FIG. 8. These stringer configurations may be combined with any of the step configurations disclosed herein.

Figure 10:
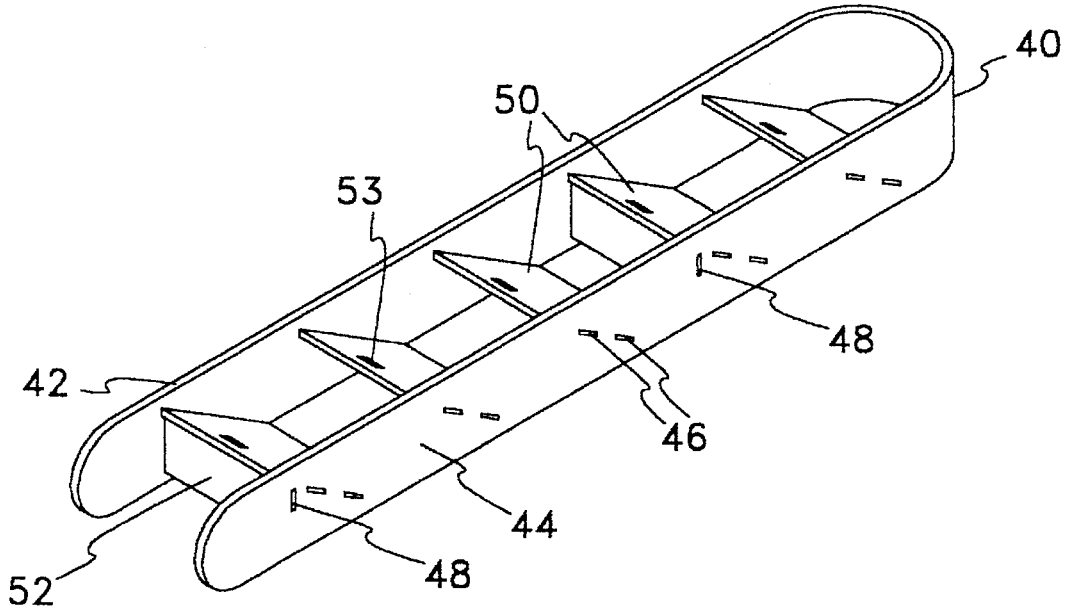
FIG. 10 is a front elevational view of another embodiment of the present invention.

Another alternate embodiment of the present invention is disclosed in FIG. 10. In this embodiment, step pieces 50 comprise only a tread portion and no riser, and have one or more tabs (not shown) formed integral to the step pieces 50. Numerous horizontal slots 46 are formed in the flexible stringer 40 in pairs, so that one or more tabs (not shown) on each side of the step pieces 50 may lock into the flexible stringer 40 on opposite sides. Braces or support pieces 52 attached vertically underneath select step pieces 50 via integral tabs (not shown) formed in their sides that lock into vertical slots 48 formed in the flexible stringer 40. The support pieces 52 each have a tab (not shown) formed in the top which fit into slots 53 formed near the front of step pieces 50 for added rigidity. This step configuration may be combined with any of the foregoing stringer configurations.

Figure 11:
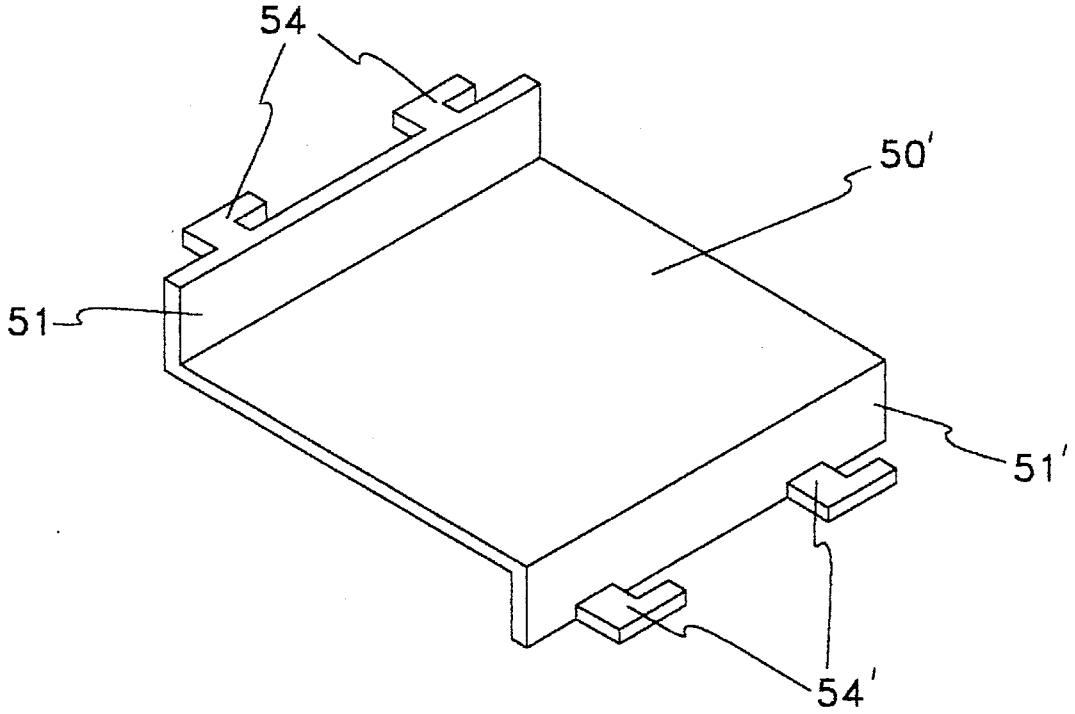
FIG. 11 is a front elevational view of a portion of an alternative embodiment of the present invention.

FIG. 11 discloses an alternate step design. Step piece 50' includes opposing flanges 51 and 51'. The flange 51 is formed integral to the step piece 50' at a right angle thereto in the upward direction. Tabs 54 are formed integral to upward flange 51 at a right angle thereto facing away from the step piece 50' The flange 51' is formed integral to the step piece 50' at a right angle thereto in the downward direction. Tabs 54' are formed integral to the downward flange 51' at a right angle thereto facing away from the step piece 50'. Because the flanges 51 and 51' are attached facing in opposite directions, step pieces 50' can still be nested for compact packaging. With this step embodiment, the slots in the side rails (not shown) must be offset corresponding to the offset of tabs 54 and 54', respectively, so that the step piece 50' is level. When tabs 54 and 54' are engaged with slots in the side rails, the flanges 51 and 51' are in full contact with the side rails, thus providing rigidity to the stairway, and no independent brace or support pieces are necessary. This step configuration may be combined with any of the foregoing stringer configurations.

The principles, preferred embodiments and the mode of operation of the present invention have been described in the foregoing specification. However, the invention which is intended to be protected is not to be construed as limited to the particular embodiments disclosed. The embodiments are therefore to be regarded as illustrative rather than restrictive. Variations and changes may be made by others without departing from the spirit of the present invention. Accordingly, it is expressly intended that all such equivalents, variations and changes which fall within the spirit and the scope of the present invention as defined in the claims be embraced thereby.

What we claim is:

1. A toy stairway in combination with a spring toy comprising:

a spring toy having a collapsed height in an unstressed state;

elongated first and second collapsible side rails in confronting spaced relationship relative to each other;

said side rails each having two generally straight edges parallel to each other;

said side rails having a width between said side edges approximately equal to the collapsed height of said spring toy;

a plurality of rigid steps disposed between said first and second side rails; and means for releasably connecting said plurality of steps to said first and second side rails, whereby said rails, steps and spring toy may be compactly stored together in a box.

2. A toy stairway as described in claim 1, wherein said first and second side rails are formed from a single stringer having a first portion and a second portion, said stringer being made of a material to permit said stringer to bend for bringing said second portion in a confronting spaced relationship relative to said first portion to define said first and second side rails.

3. A toy stairway as described in claim 2, wherein said stringer is made of a coilable resilient material.

4. A toy stairway as described in claim 2, wherein said stringer is made of a foldable material comprised of a plurality of hingedly connected fold sections.

5. A toy stairway as described in claim 1, wherein said side rails are coilable and resilient.

6. A toy stairway as described in claim 1, wherein each said side rail is foldable and is comprised of a plurality of hingedly connected fold sections.

7. A toy stairway as described in claim 1, wherein each of said rigid steps comprises an L-shaped step piece having a tread portion and a riser portion.

8. A toy stairway as described in claim 1, wherein each of said rigid steps comprises a flat tread.

9. A toy stairway as described in claim 8, wherein said toy staircase further comprises at least one brace portion connectable between said side rails.

10. A toy stairway as described in claim 1, wherein each said rigid step comprises a tread portion hingedly attached to a riser portion.

11. A toy stairway as described in claim 10, wherein there are a plurality of said hingedly attached tread and riser portions hingedly attached to each other to form a continuous set of said rigid steps.

12. A toy stairway as described in claim 1 wherein said means for connecting said steps between said side rail comprises:

first connecting means attached to said steps, and second connecting means attached to each of said first and second side rails for interlockingly engaging said first connecting means for holding said steps to said side rails.

13. A stairway apparatus in combination with a spring toy comprising:

a spring toy having a collapsed height in an unstressed state;

a first elongated coilable resilient strip section and a second elongated coilable resilient strip section, said second section being in a confronting spaced relationship with said first section to define a spaced area therebetween, said first and second sections having connecting members positioned along their lengths;

each of said strip sections having parallel sides and a width between said sides approximately equal to said collapsed height of said spring toy; and step members proportioned to fit in the spaced area between said strip sections, said step members having connecting members thereon adapted to engage said connecting members on said strip sections for holding said step members to said strip portions, whereby said rails, strip sections and spring toy may be compactly stored together in a box.

14. A stairway apparatus as described in claim 13, wherein said first and second strip sections are formed from a continuous strip member bent to bring said second strip section in confronting spaced relationship with said first strip section.

15. A stairway apparatus as described in claim 13, further comprising at least one brace portion proportioned to fit in the spaced area between said first strip section and said second strip section and having connecting members thereon adapted to engage said connecting members on said strip section for holding said strip members in spaced relation to one another.

16. A stairway apparatus in combination with a spring toy comprising:

a spring toy having a collapsed height in an unstressed state:

a first elongated collapsible strip section and a second elongated collapsible strip section, said sections each having generally straight parallel sides, said sides defining a width approximately equal to the collapsed height of said spring toy, said second section being in a confronting spaced relationship relative to said first section to define a spaced area therebetween, said first and second sections having connecting means positioned along their lengths for holding said first strip section and said second strip section in spaced relation to one another; and, a plurality of steps proportioned to fit in the spaced area between said strip sections and being formed of a plurality of tread portions hingedly attached to a plurality of riser portions, said step members having connection means thereon adapted to engage said connecting means on said strip sections, whereby said rails, strip sections and spring toy may be compactly stored together in a box.

17. A stairway apparatus in combination with a spring toy comprising:

a spring toy having a collapsed height in an unstressed state;

a first elongated collapsible strip section and a second elongated collapsible strip section, said second section being in a confronting spaced relationship with said first section to define a spaced area therebetween, said first and second sections having connecting means positioned along their lengths for holding said first strip section and said second strip section in spaced relation to one another; and, a plurality of step pieces proportioned to fit in the spaced area between said strip sections, each said step piece being formed of a tread portion connected to a riser portion, said step pieces having connection means thereon adapted to engage said connecting means on said strip sections, said strip sections each having generally parallel spaced sides, defining a width approximately equal to the collapsed height of said spring toy, whereby said rails, strip sections and spring toy may be compactly stored together in a box.

18. A stairway apparatus as described in claim 17, wherein said tread portions are rigidly connected to said riser portions at substantially right angles.

* * * * *